US011101605B2

(12) United States Patent
Zhang et al.

(10) Patent No.: US 11,101,605 B2
(45) Date of Patent: Aug. 24, 2021

(54) MALE PLUG, FEMALE SOCKET AND BOARD-TO-BOARD RF CONNECTOR

(71) Applicant: Electric Connector Technology Co., Ltd., Shenzhen (CN)

(72) Inventors: Sean Zhang, Shenzhen (CN); Kevin Yin, Shenzhen (CN)

(73) Assignee: Electric Connector Technology Co., Ltd., Shenzhen (CN)

( * ) Notice: Subject to any disclaimer, the term of this patent is extended or adjusted under 35 U.S.C. 154(b) by 0 days.

(21) Appl. No.: 16/836,040

(22) Filed: Mar. 31, 2020

(65) Prior Publication Data

US 2021/0175666 A1 Jun. 10, 2021

(30) Foreign Application Priority Data

Dec. 10, 2019 (CN) ..... 201911262026.2

(51) Int. Cl.

| | |
|---|---|
| ***H01R 13/60*** | (2006.01) |
| ***H01R 13/659*** | (2011.01) |
| ***H01R 13/514*** | (2006.01) |
| ***H01R 13/518*** | (2006.01) |

(52) U.S. Cl.

CPC ..... *H01R 13/659* (2013.01); *H01R 13/514* (2013.01); *H01R 13/518* (2013.01)

(58) Field of Classification Search

CPC .. H01R 13/659; H01R 13/514; H01R 13/516; H01R 13/518

USPC ..... 439/540.1

See application file for complete search history.

(56) References Cited

U.S. PATENT DOCUMENTS

| | | | | |
|---|---|---|---|---|
| 9,997,852 | B2 * | 6/2018 | Chen | H01R 12/716 |
| 2018/0076549 | A1 | 3/2018 | Chen | |

OTHER PUBLICATIONS

European Patent Office: Extended Search Report of EP Application No. 20166843.1-1201 (related application); The Hague; Gomes Sirenkov E M.; Aug. 7, 2020; 10 pages.

* cited by examiner

*Primary Examiner* — Khiem M Nguyen

(57) ABSTRACT

The present disclosure discloses a board-to-board RF connector including a male plug and a female socket which are mated. The male plug includes: a male plug insulation body; at least two male plug high-frequency signal terminals arranged on the male plug insulation body; at least two male plug low-frequency signal terminals arranged on the male plug insulation body; a male plug shield terminal located between the male plug low-frequency signal terminals and the male plug high-frequency signal terminals and arranged on the male plug insulation body. In contrast with the conventional technology, it is capable of realizing transmissions of the high-frequency signal and the low-frequency signal, meanwhile, it is also capable of reducing the influence caused by the high frequency signal interferes with the low frequency signal.

19 Claims, 6 Drawing Sheets

MALE PLUG, FEMALE SOCKET AND BOARD-TO-BOARD RF CONNECTOR

CROSS-REFERENCE TO RELATED APPLICATIONS

The present application claims the priority of the Chinese Patent Application No. 201911262026.2, filed on Dec. 10, 2019 and titled MALE PLUG, FEMALE SOCKET AND BOARD-TO-BOARD RF CONNECTOR, and the content of which is incorporated by reference herein in its entirety, the specification of which is incorporated by reference herein in its entirety.

TECHNICAL FIELD

The present disclosure relates to a field of electrical connector technology, and more specifically to a male plug, a female socket and a board-to-board RF connector.

BACKGROUND

Channel is a basis of wireless communication, the deeper comprehend for the channel is, the higher efficiency of coding and modulation is, and the closer to the theory limit line of Shannon Theorem is. However, the communication mode of multichannel makes the channel extremely complex. A multiple input multiple output (MIMO) technology contributes significant effect for improving spectrum utilization, and will become a key technology for the 5G-scale application. Nowadays, with respect to the connector, a multichannel radio frequency (RF) connector performs transmission in coordination with future 5G-multichannel and fully utilizes a space despite of the space is very small, besides, the definition for pad and PIN thereof is various.

The conventional technology has disclosed a board-to-board connector assembly which includes a plug connector and a socket connector. The plug connector includes a plurality of plug terminals which mutually and opposite disposed in two rows and arranged in horizontal direction, and the socket connector includes a plurality of socket terminals which mutually and opposite disposed in longitudinal direction and arranged along two sides of a corresponding horizontal cavity in equidistance.

The above board-to-board connector assembly of the conventional technology has disadvantage that it cannot realize transmissions of high-frequency signal and low-frequency signal in concurrency.

SUMMARY

A male plug, a female socket, and a board-to-board RF connector are provided which are capable of reducing an influence caused by the high frequency signal interferes with the low frequency signal based on the realizing of transmissions of a high-frequency signal and a low-frequency signal.

In order to achieve the above-mentioned object, a technical solution provided by the present disclosure is:

A male plug includes:

a male plug insulation body;

at least two male plug high-frequency signal terminals arranged on the male plug insulation body;

at least two male plug low-frequency signal terminals arranged on the male plug insulation body;

a male plug shield terminal located between the male plug low-frequency signal terminals and the male plug high-frequency signal terminals and located on the insulation body; and a male plug shield housing arranged on the male plug insulation body.

Preferably, each of the male plug high-frequency signal terminals includes a first contact portion being in an arched shape and a first fixing portion being in a long strip shape; each of the male plug low-frequency signal terminals includes a second contact portion being in an arched shape and a second fixing portion being in a long strip shape; the number of the male plug high-frequency signal terminals is two and the number of the male plug shield terminal being two; a first male plug high-frequency signal terminal is located at a left side of the at least two male plug low-frequency signal terminals, and a first male plug shield terminal is located between the first male plug high-frequency signal terminal and the at least two male plug low-frequency signal terminals; a second male plug high-frequency signal terminal is located at a right side of the at least two male plug low-frequency signal terminals, and a second male plug shield terminal is located between the second male plug high-frequency signal terminal and the at least two male plug low-frequency signal terminals.

Preferably, the male plug insulation body includes a first bottom portion, a first tongue portion being protruded, a second tongue portion being protruded, and a third tongue portion being protruded; the first tongue portion is located at a left side of the first male plug shield terminal, the second tongue portion is located between the first male plug shield terminal and the second male plug shield terminal, and the third tongue portion is located at a right side of the second male plug shield terminal; the two male plug shield terminals being embedded inside the first bottom portion and are in a long strip shape, and both top surfaces of the two male plug shield terminals are flushed with a surface of the first bottom portion; one end of each of the two male plug shield terminals is adjacent to an inner wall surface of the male plug shield housing, and another end of each of the two male plug shield terminals is adjacent to the inner wall surface of the male plug shield housing; the first contact portion of the first male plug high-frequency signal terminal is fixed on the first tongue portion, and the first fixing portion of the first male plug high-frequency signal terminal is embedded inside the first bottom portion; the first contact portion of the second male plug high-frequency signal terminal is fixed on the third tongue portion, the first fixing portion of the second male plug high-frequency signal terminal is embedded inside the first bottom portion, the second contact portion of each of the male plug low-frequency signal terminals is fixed on the second tongue portion, the second fixing portion of each of the male plug low-frequency signal terminals is embedded inside the first bottom portion.

Preferably, the first male plug high-frequency signal terminal and the second male plug high-frequency signal terminal are rotationally symmetric; the at least two male plug low-frequency signal terminals are arranged in pairs, and each pair of the male plug low-frequency signal terminals is rotationally symmetric to another.

Preferably, the first male plug high-frequency signal terminals, the male plug low-frequency signal terminals and the male plug shield terminals are fixed together by inserting molding.

A female socket includes:

a female socket insulation body;

at least two female socket high-frequency signal terminals arranged on the female socket insulation body;

at least two female socket low-frequency signal terminals arranged on the female socket insulation body;

a female socket shield terminal located between the female socket low-frequency signal terminals and the female socket high-frequency signal terminals and located on the insulation body; and a female socket shield housing arranged on the female socket insulation body.

Preferably, each of the female socket high-frequency signal terminals includes a third contact portion being in an U-shape and a third fixing portion being in a L-shape; each of the female socket low-frequency signal terminals comprises a fourth contact portion being in an U-shape and a fourth fixing portion being in a long strip shape, the female socket shield terminal is in a strip shape and is high in middle and low in both sides; one end of the female socket shield terminal is adjacent to an inner wall surface of the female socket shield housing and another end of the female socket shield terminal is adjacent to the inner wall surface of the female socket shield housing; the number of the female socket high-frequency signal terminals is two and the number of the female socket shield terminal is two; a first female socket high-frequency signal terminal is located at a left side of the at least two female socket low-frequency signal terminals, and a first female socket shield terminal is located between the first female socket high-frequency signal terminal and the at least two female socket low-frequency signal terminals; a second female socket high-frequency signal terminal is located at a right side of the at least two female socket low-frequency signal terminals, and a second female socket shield terminal being located between the second female socket high-frequency signal terminal and the at least two female socket low-frequency signal terminals.

Preferably, the female socket insulation body includes a second bottom, a first slot, a second slot, and a third slot; the first slot is located at a left side of the first female socket shield terminal, the second slot is located between the first female socket shield terminal and the second female socket shield terminal, and the third slot is located at a right side of the second male plug shield terminal; the third contact portion of the first female socket high-frequency signal terminal is fixedly connected to the first slot, the third contact portion of the second female socket high-frequency signal terminal is fixedly connected to the third slot, and the fourth contact portion of each of the female socket low-frequency signal terminals is fixedly connected to the second slot.

Preferably, the first female socket high-frequency signal terminal and the second female socket high-frequency signal terminal are rotationally symmetric; the at least two female socket low-frequency signal terminals are arranged in pairs, and each pair of the female socket low-frequency signal terminals is rotationally symmetric to another.

Preferably, the female socket low-frequency signal terminals and the second slot are fixed together by inserting molding.

A board-to-board radio frequency (RF) connector includes a male plug and a female socket, the male plug and the female socket are mated, a first contact portion of each of male plug high-frequency signal terminals is contacted with a third contact portion of each of female socket high-frequency signal terminals and a second contact portion of each of the male plug low-frequency signal terminals is contacted with a fourth contact portion of each of the female socket low-frequency signal terminals.

The advantages of the present invention are: the male plug shield terminals can isolate a single male plug high-frequency signal terminal from the male plug low-frequency signal terminals and isolate another male plug high-frequency signal terminal from the male plug low-frequency signal terminals, so as to reduce the influence caused by electromagnetic interference therebetween, and to allow a plurality of male plug low-frequency signal terminals to be arranged between the male plug high-frequency signal terminals. In addition, the female socket shield terminals which can isolate a single female socket high-frequency signal terminal from the female socket low-frequency signal terminals and isolate another female socket high-frequency signal terminal from the female socket low-frequency signal terminals, so as to reduce the influence caused by electromagnetic interference therebetween, and to allow a plurality of female socket low-frequency signal terminals to be arranged between the female socket high-frequency signal terminals. The single male plug high-frequency signal terminal and another male plug high-frequency signal terminal are rotationally symmetrical, and at least two male plug low-frequency signal terminals are arranged in pairs, each pair of the male plug low-frequency signal terminals is rotationally symmetrical to another. The single female socket high-frequency signal terminal and another female socket high-frequency signal terminal are rotationally symmetrical, and at least two female socket low-frequency signal terminals are arranged in pairs, each pair of the female socket low-frequency signal terminals is rotationally symmetrical to another, thereby realizing compatibly positive and reverse insertions between the male plug and the female socket. In contrast with the conventional technology, it is capable of realizing transmissions of the high-frequency signal and the low-frequency signal, meanwhile, it is also capable of reducing the influence caused by the high frequency signal interferes with the low frequency signal.

DETAILED DESCRIPTION

In order to make the above-mentioned objects, features and advantages of the present disclosure more clearly and understandable, the specific embodiments of the present disclosure will be described in detail with reference to the accompanying drawings. For the sake of fully understanding the present disclosure, many specific details are set forth in the following description. However, the present disclosure can be implemented in many other ways different from those described herein. Those skilled in the art can make similar improvements without departing from the principle of the present disclosure, thus the present disclosure should not be limited by the specific implementation disclosed below.

Figure 1:
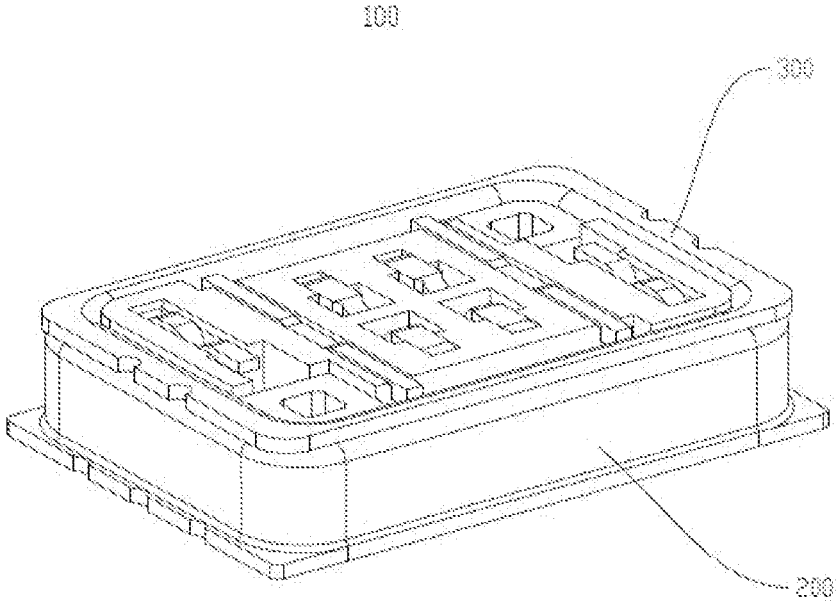
FIG. 1 is a schematic view of a male plug mating a female socket in an embodiment of the present disclosure.

As shown in FIG. 1, the present embodiment discloses a board-to-board radio frequency (RF) connector 100 including a male plug 200 and a female socket 300 which can be mated each other.

Figure 2:
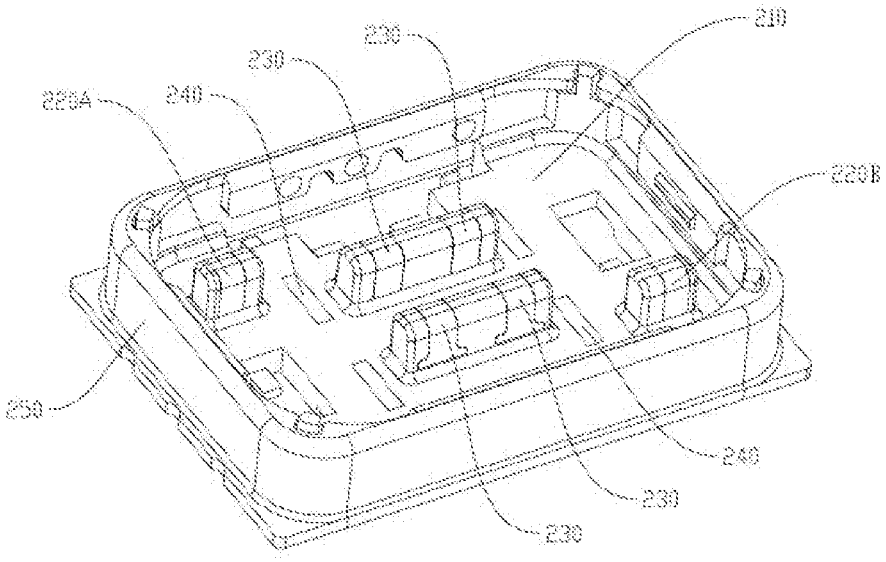
FIG. 2 is a schematic view of a structure of the male plug in an embodiment of the present disclosure.

As shown in FIG. 2, the male plug 200 includes a male plug insulation body 210, two male plug high-frequency signal terminals 220A and 220B, a plurality of male plug low-frequency signal terminals 230, a male plug shield terminal 240, and a male plug shield housing 250.

The male plug insulation body 210 is substantially in a shape of cube plate and made up of insulation engineering plastics which is generally high-frequency material with low dielectric constant, such as liquid crystal polymer (LCP).

Figure 3:
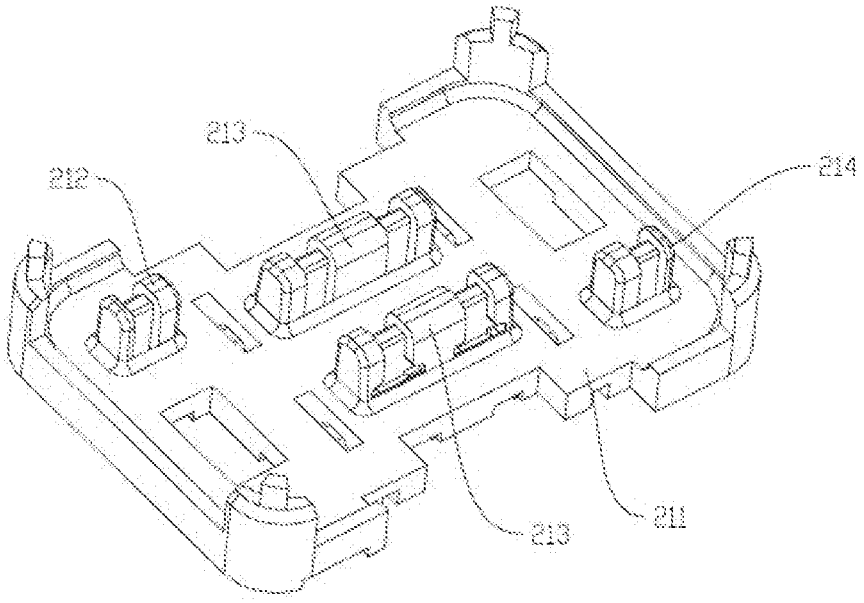
FIG. 3 is a schematic view of a male plug insulation body in an embodiment of the present disclosure.

As shown in FIG. 3, the male plug insulation body 210 includes a protruding first bottom portion 211, a protruding first tongue portion 212, a protruding second tongue portion 213, and a protruding third tongue portion 214.

The first bottom portion 211 is substantially in a shape of square plate.

The first tongue portion 212 is formed by protruding from a surface of the first bottom portion.

The second tongue portion 213 is formed by protruding from the surface of the first bottom portion.

The third tongue portion 214 is formed by protruding from the surface of the first bottom portion.

The second tongue portion 213 is located between the first tongue portion 212 and the third tongue portion 214.

Figure 4:
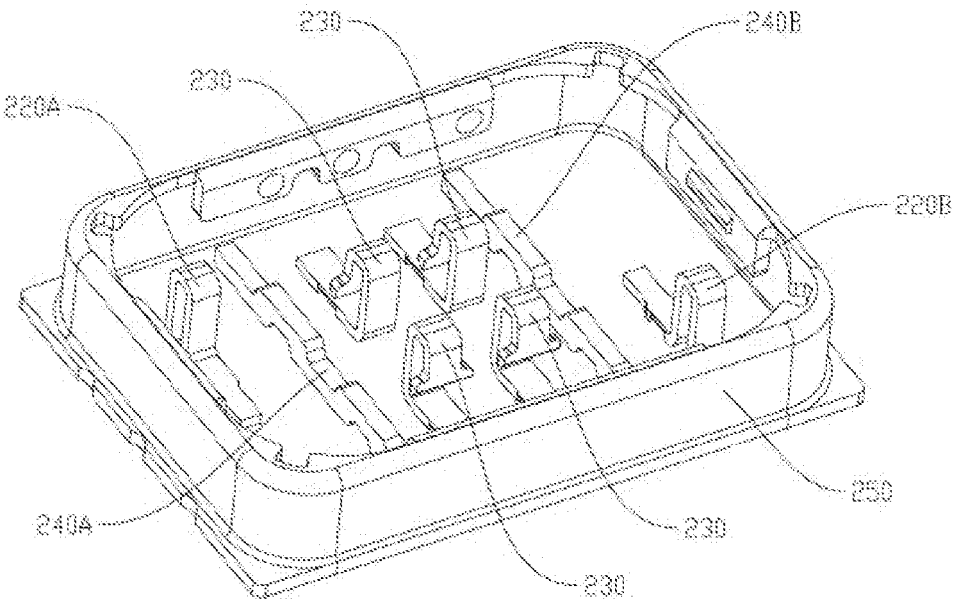
FIG. 4 is a schematic view of structures and positions for male plug low-frequency signal terminals, male plug high-frequency signal terminals, male plug shield terminals, and a male plug shield housing in an embodiment of the present disclosure.
Figure 5:
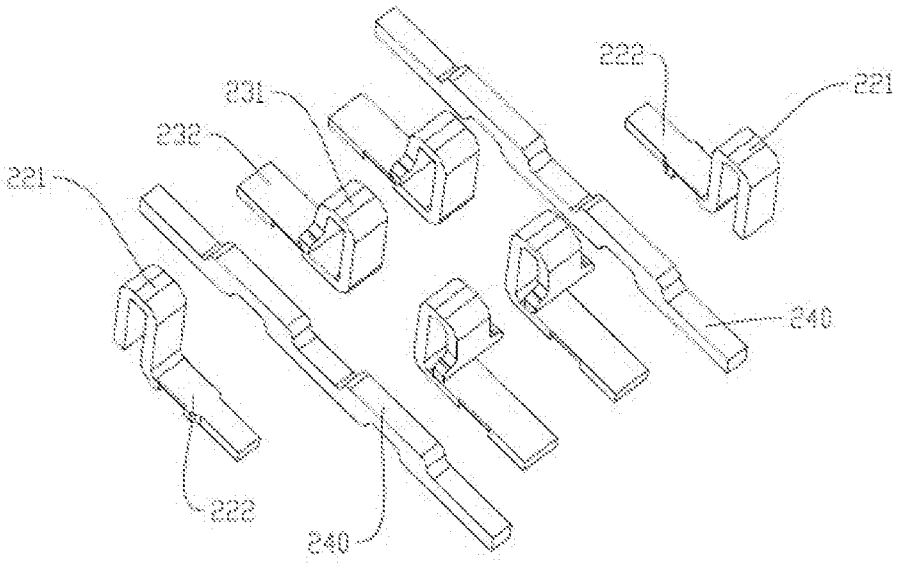
FIG. 5 is a schematic view of structures and positions for the male plug low-frequency signal terminals, the male plug high-frequency signal terminals, and the male plug shield terminals in an embodiment of the present disclosure.

As shown in FIG. 4 and FIG. 5, the two male plug high-frequency signal terminals 220 are shaped by metal insertion-molding with metal material which is generally copper alloy. Each male plug high-frequency signal terminal 220 includes a first contact portion 221 and a first fixing portion 222. The first contact portion 221 is in an arched shape. The first fixing portion 222 is in a long strip shape and embedded inside the first bottom 211.

The first contact portion 221 of a first male plug high-frequency signal terminal 220A is fixedly connected to the first tongue portion 212, and preferably, the first male plug high-frequency signal terminal 220A, the first bottom portion 211 and the first tongue portion 212 are fixed together by insert molding.

The first contact portion 221 of a second male plug high-frequency signal terminal 220B is fixedly connected to the second tongue portion 213, and preferably, the second male plug high-frequency signal terminal 220B, the first bottom portion 211 and the third tongue portion 214 are fixed together by insert molding.

The first male plug high-frequency signal terminal 220A and the second male plug high-frequency signal terminal 220B are rotationally symmetric.

As shown in FIG. 4 and FIG. 5, the male plug low-frequency signal terminals 230 are in a strip shape and arranged in pairs. Each pair of the male plug low-frequency signal terminals 230 is rotationally symmetric to another. Preferably, two pairs of the male plug low-frequency signal terminals 230 are arranged and shaped by metal insertion-molding with metal material which is generally copper alloy. Each male plug low-frequency signal terminal 230 includes a second contact portion 231 and a second fixing portion 232. The second contact portion 231 is in an arched shape. The second fixing portion 232 is in a long strip shape and embedded inside the first bottom 211.

The second contact portion 231 of the each male plug high-frequency signal terminal 230 is fixedly connected to the second tongue portion 213, and preferably, the each male plug low-frequency signal terminal 230, the first bottom portion 211 and the second tongue portion 213 are fixed together by insert molding.

As shown in FIG. 4 and FIG. 5, the male plug shield terminal 240 is in a long strip shape and shaped by metal insertion-molding with metal material which is generally copper alloy. Preferably, two male plug shield terminals 240 are arranged. A first male plug shield terminal 240A is located between the first male plug high-frequency signal terminal 220A and the male plug low-frequency signal terminals 230, so as to reduce the influence caused by the first male plug high-frequency signal terminal electromagnetically interferes with the male plug low-frequency signal terminals.

A second male plug shield terminal 240B is located between the second male plug high-frequency signal terminal 220B and the male plug low-frequency signal terminals 230, so as to reduce the influence caused by the second male plug high-frequency signal terminal electromagnetically interferes with the male plug low-frequency signal terminals.

Both two male plug shield terminals 240 and 240B are embedded inside the first bottom portion 211 and top surfaces of the both male shield terminals 240 and 240B are flush with a surface of the first bottom portion 211. By the structure mentioned above, the male plug shield terminals and the male plug shield housing 250 form a shield layer, so as to reduce the external signal interference that the male plug high-frequency signal terminals 220 subject to and/or reduce the signal interference to the male plug low-frequency signal terminals 230. Preferably, one end of each of the two male plug shield terminals 240 and 240B is adjacent to an inner wall surface of the male plug shield housing 250, and the other end of each of the two male plug shield terminals 240 and 240B is also adjacent to the inner wall surface of the male plug shield housing 250, so as to improve the shielding effect.

The male plug shield housing 250 is shaped by metal insertion-molding with metal material which is generally copper alloy.

Figure 6:
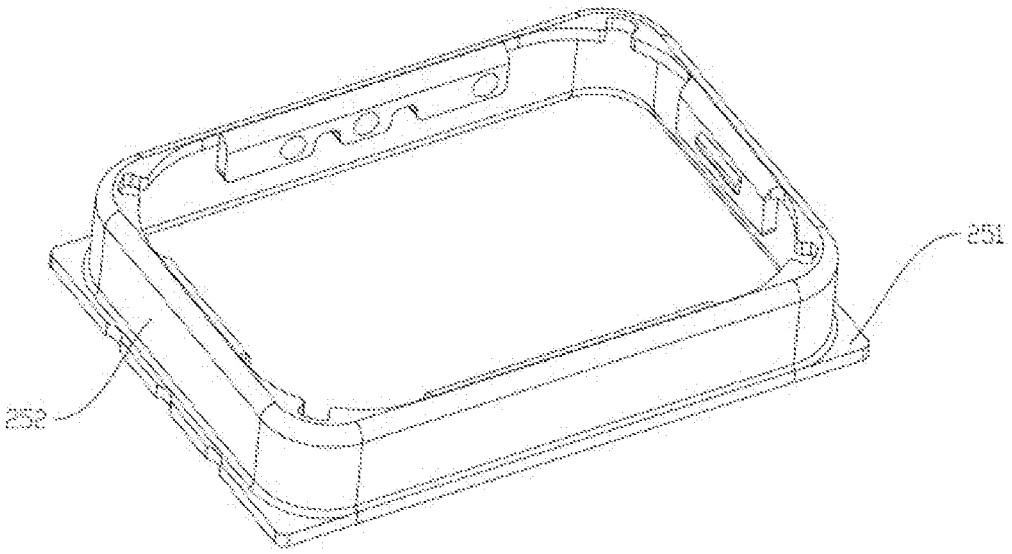
FIG. 6 is a schematic view of the structure and position for the male plug shield housing in an embodiment of the present disclosure.

As shown in FIG. 6, the male plug shield housing 250 includes a first ring bottom portion 251 and a first cylindrical wall portion 252.

The first ring bottom portion 251 is substantially in a shape of square and hollow plate.

The first cylindrical wall portion 252 is formed by protruding upwards along an edge of an inner hole of the first ring bottom portion, and the first bottom portion 211 of the insulation body is located within the first cylindrical wall portion 252, so as to reduce the influence, caused by an external electromagnetic signal, on the male plug high-frequency signal and low-frequency signal terminals.

Figure 7:
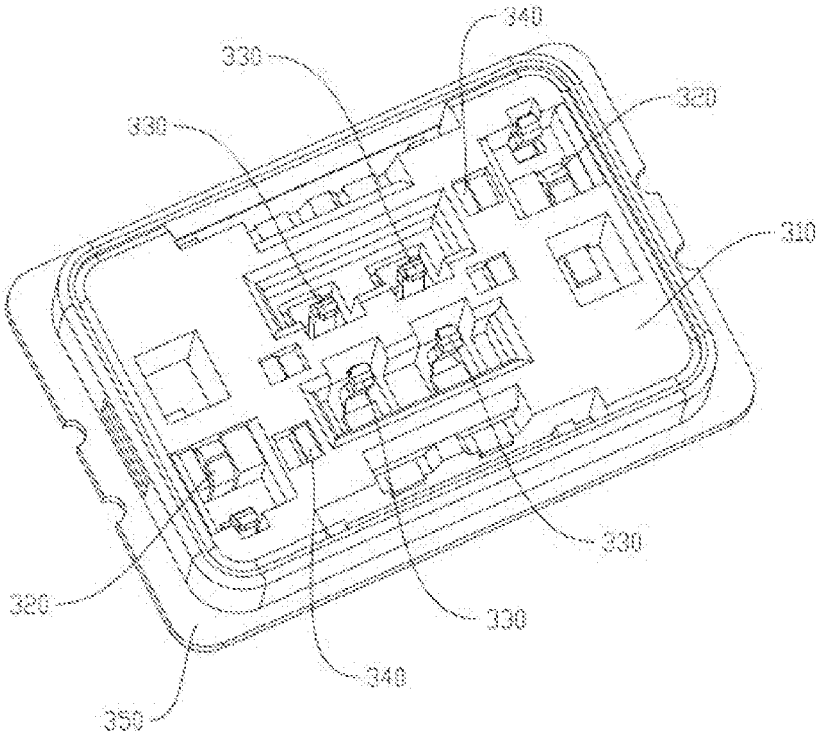
FIG. 7 is a schematic view of a structure of the female socket in an embodiment of the present disclosure.

As shown in FIG. 7, the female socket 300 includes a female socket insulation body 310, two female socket high-frequency signal terminals 320, a plurality of female socket low-frequency signal terminals 330, one or more female socket shield terminals 340, and a female socket shield housing 350.

The male plug insulation body 310 is substantially in a shape of cube plate and made up of insulation engineering plastics which is generally a high-frequency material with low dielectric constant such as LCP.

Figure 8:
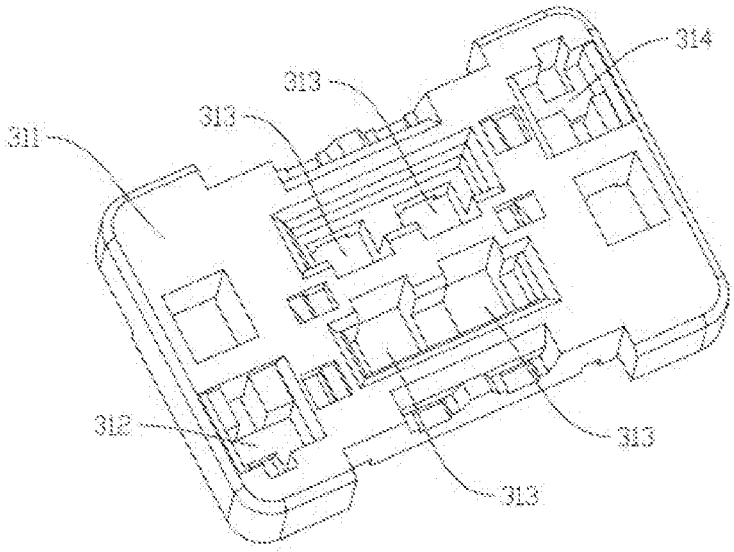
FIG. 8 is a schematic view of a female socket insulation body in an embodiment of the present disclosure.

As shown in FIG. 8, the female socket insulation body 310 includes a second bottom portion 311, a first slot 312, a second slot 313, and a third slot 314.

The second bottom portion 311 is substantially in a shape of square plate.

The first slot 312 is arranged at the second bottom portion 311 and able to be inserted by and couple with the first tongue portion 212.

The second slot 313 is arranged at the second bottom portion 311 and able to be inserted by and coupled with the second tongue portion 213.

The third slot 314 is arranged at the second bottom portion 311 and able to be inserted by and coupled with the third tongue portion 214.

Figure 9:
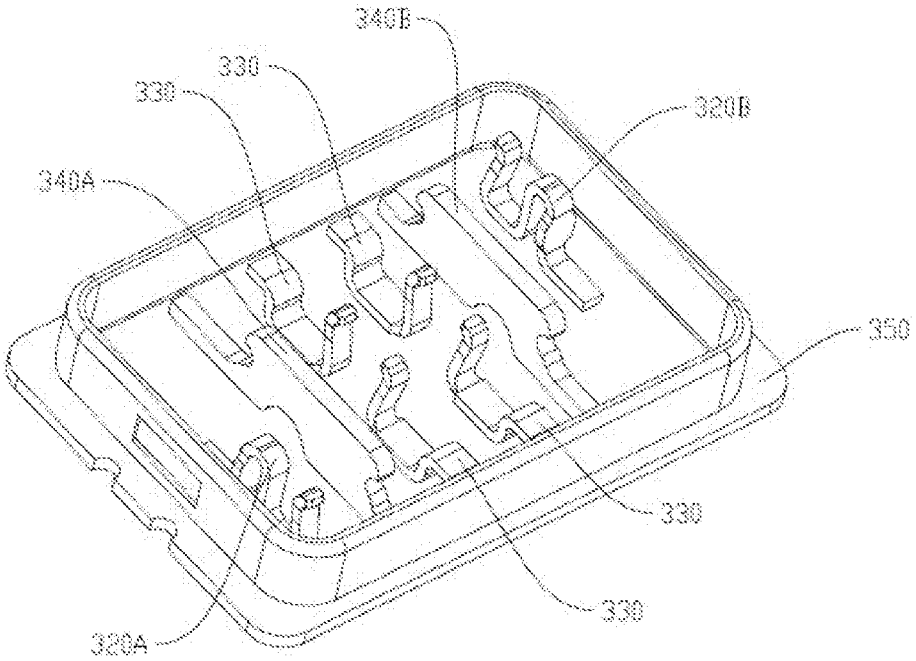
FIG. 9 is a schematic view of structures and positions for female socket low-frequency signal terminals, female socket high-frequency signal terminals, female socket shield terminals, and a female socket shield housing in an embodiment of the present disclosure.
Figure 10:
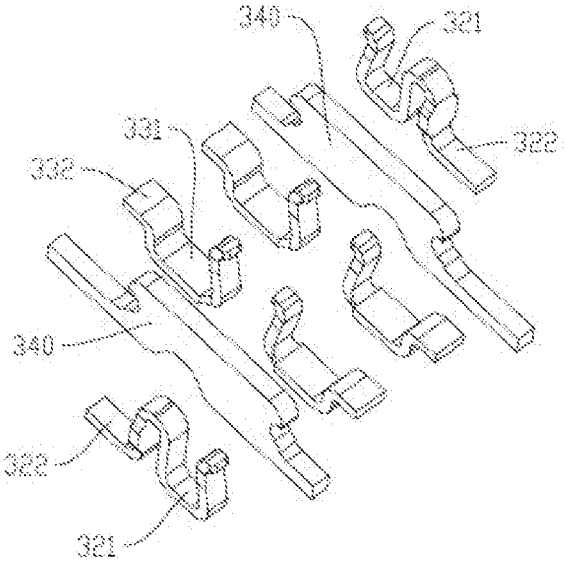
FIG. 10 is a schematic view of structures and positions for the female socket low-frequency signal terminals, the female socket high-frequency signal terminals, and the female socket shield terminals in an embodiment of the present disclosure.

As shown in FIG. 9 and FIG. 10, the two female socket high-frequency signal terminals 310A and 320B are in a strip shape and shaped by metal insertion-molding with metal material which is generally copper alloy. Each female socket high-frequency signal 320 includes a third contact portion 321 and a third fixing portion 322. The third contact portion 321 is in a U-shape, and third fixing portion 322 is in a L-shape.

The third contact portion 321 of first female socket high-frequency signal terminal 320A is fixedly connected to the first slot 312, and preferably, the first female socket high-frequency signal terminal 320A, the second bottom portion 311 and the first slot 312 are fixed together by inserting molding. The third contact portion 321 of first female socket high-frequency signal terminal 320A contacts with the first contact portion 221 of the first male plug high-frequency signal terminal 220A by the first tongue portion 212 insert into and couple with the first slot 312, so as to realize a high-frequency signal transmission.

The third contact portion 321 of second female socket high-frequency signal terminal 320B is fixedly connected to the third slot 314, and preferably, the second female socket high-frequency signal terminal 320B, the second bottom portion 311 and the third slot 314 are fixed together by inserting molding. The third contact portion 321 of second female socket high-frequency signal terminal 320B contacts with the first contact portion 221 of the second male plug high-frequency signal terminal 220B by the third tongue portion 214 insert into and couple with the third slot 314, so as to realize a high-frequency signal transmission.

The first female socket high-frequency signal terminal 320A and the second female socket high-frequency signal terminal 320B are rotationally symmetric.

As shown in FIG. 9 and FIG. 10, the female socket low-frequency signal terminals 330 are in a strip shape and arranged in pairs, each pair of the female socket low-frequency signal terminals is rotationally symmetric to another, and preferably, two pairs of the female socket low-frequency signal terminals are arranged and shaped by metal insertion-molding with metal material which is generally copper alloy.

Each female socket low-frequency signal terminal 330 includes a fourth contact portion 331 and a fourth fixing portion 332. The fourth contact portion 331 is in a U-shape, and the fourth fixing portion 332 is in a long strip shape and embedded inside the first bottom 211.

Each of the female socket high-frequency signal terminals 330 is fixedly connected to the second slot 313, and preferably, the each male plug low-frequency signal terminal 330, the second bottom portion 311 and the second slot 313 are fixed together by inserting molding. The fourth contact portion 331 of each female socket low-frequency signal terminal 330 contacts with the second contact portion 231 of each male plug low-frequency signal terminal 230 by the second tongue portion 213 insert into and couple with the second slot 313, so as to realize a low-frequency signal transmission.

As shown in FIG. 9 and FIG. 10, the female socket shield terminals 340 are in a strip shape and shaped by metal insertion-molding with metal material which is generally copper alloy. Preferably, two female socket shield terminals 340 are provided. A first female socket shield terminal 340A is located between the first female socket high-frequency signal terminal 320A and the female socket low-frequency signal terminals 330, so as to reduce the influence caused by the first female socket high-frequency signal terminal electromagnetically interferes with the female socket low-frequency signal terminals.

A second female socket shield terminal 340B is located between the second female socket high-frequency signal terminal 320B and the female socket low-frequency signal terminals 330, so as to reduce the influence caused by the second female socket high-frequency signal terminal electromagnetically interferes with the female socket low-frequency signal terminals.

In terms of the above structure, the female socket shield terminals 340 and the female socket shield housing 350 form a shield layer, so as to reduce the external signal interference that the female socket high-frequency signal terminals 320 subject to and/or reduce the signal interference to the female socket high-frequency signal terminals 320. Preferably, the shape of each of female socket shield terminals 340 is high in middle and low in both sides. One end of each of the two female socket shield terminals 340 is adjacent to an inner wall surface of the female socket housing 350, and another end of each of the two female socket shield terminals 340 is also adjacent to the inner wall surface of the female socket housing 350, so as to improve the shield effect.

Figure 11:
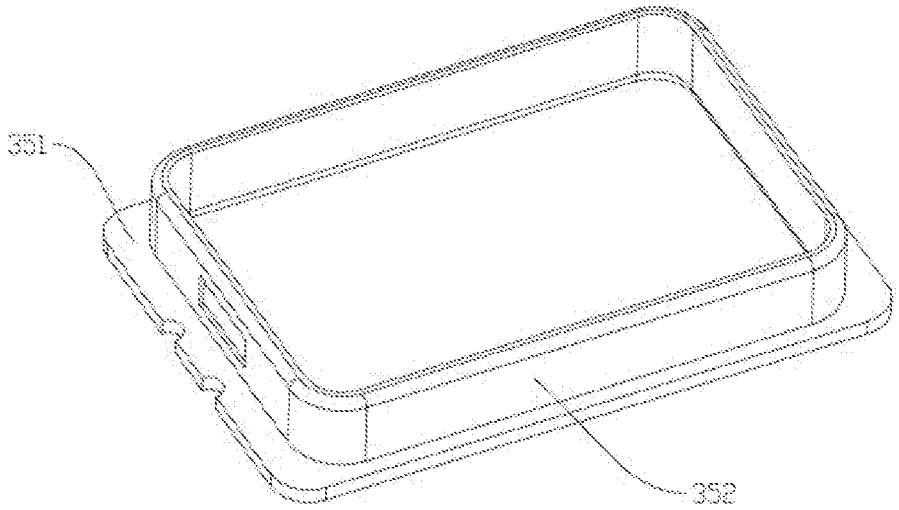
FIG. 11 is a schematic view of the structure and position for the female socket shield housing in an embodiment of the present disclosure.

As shown in FIG. 11, the female socket shield housing 350 is shaped by metal insertion-molding with metal material which is generally copper alloy.

The female socket shield housing 350 includes a second ring bottom portion 351 and a second cylindrical wall portion 352.

The second bottom portion 351 is substantially in a shape of square and hollow plate.

The second cylindrical wall portion 352 is formed by protruding upwards along an edge of an inner hole of the second ring bottom portion 351, an inner hole of the second cylindrical wall portion 352 fits with a peripheral surface of the first cylindrical wall portion 351, and the second bottom portion 311 of the female socket insulation body is located within the second cylindrical wall portion 352, so as to reduce the influence caused by an external electromagnetic signal on the female socket high-frequency signal and low-frequency signal terminals.

In order to address the problem existing in the conventional technology that a small space does not facilitate to arrange pads, the present disclosure utilizes the male plug shield terminals which can isolate a single male plug high-frequency signal terminal from the male plug low-frequency signal terminals and isolate another male plug high-frequency signal terminal from the male plug low-frequency signal terminals, so as to reduce the influence caused by electromagnetic interference therebetween, and to allow a plurality of male plug low-frequency signal terminals to be arranged between the male plug high-frequency signal terminals. In addition, the present disclosure also utilizes the female socket shield terminals which can isolate a single female socket high-frequency signal terminals from the female socket low-frequency signal terminals and isolate another female socket high-frequency signal terminal from the female socket low-frequency signal terminals, so as to reduce the influence caused by electromagnetic interference therebetween, and to allow a plurality of female socket low-frequency signal terminals to be arranged between the female socket high-frequency signal terminals. Meanwhile, the single male plug high-frequency signal terminal and another male plug high-frequency signal terminal are rotationally symmetric, and at least two male plug low-frequency signal terminals are arranged in pairs where each pair of the male plug low-frequency signal terminals is rotationally symmetric to another. The single female socket high-frequency signal terminal and another female socket high-frequency signal terminal are rotationally symmetric, and at least two female socket low-frequency signal terminals are arranged in pairs where each pair of the female socket low-frequency signal terminals is rotationally symmetric to another. Accordingly the male plug or the female socket can be compatible with inserting and coupling in both forward and reverse directions, like USB-C. In contrast with the conventional technology, reducing the influence caused by the high frequency signal interferes with the low frequency signal can be achieved based on the implementing of transmissions of the high-frequency signal and the low-frequency signal.

The above-mentioned "inserting molding" refers to a formation process includes: implanting a resin after inserting a pre-prepared embedment part with different material into a mold, bonding and solidifying the molten material and the inserted part, to make an integrated product.

The technical features of the above-mentioned embodiments may be arbitrarily combined. For the sake of concise description, not all possible combinations of the technical features in the above-mentioned embodiments are described. However, as long as there is no contradiction between the combinations of these technical features, it should be considered as the scope of the present description.

The above described embodiments are merely illustrative of several embodiments of the present disclosure, and the description thereof is more specific and detailed, but is not to be construed as limiting the scope of the present disclosure. It should be noted that several variations and modifications may be made by those persons skilled in the art and belong to the scope of protection of the present disclosure without departing from the spirit. Therefore, the scope of protection of the present disclosure should be subject to the appended claims.

What is claimed is:

1. A male plug, comprising:

a male plug insulation body;

at least two male plug high-frequency signal terminals arranged on the male plug insulation body;

at least two male plug low-frequency signal terminals arranged on the male plug insulation body;

a male plug shield terminal located between the male plug low-frequency signal terminals and the male plug high-frequency signal terminals; and a male plug shield housing arranged on the male plug insulation body;

wherein the male plug shield terminal is embedded inside the male plug insulation body.

2. The male plug according to claim 1, wherein:

each of the male plug high-frequency signal terminals comprises a first contact portion being in an arched shape and a first fixing portion being in a long strip shape, and each of the male plug low-frequency signal terminals comprises a second contact portion being in an arched shape and a second fixing portion being in a long strip shape;

the number of the male plug high-frequency signal terminals being two and the number of the male plug shield terminal being two;

a first of the male plug high-frequency signal terminals being located at a left side of the at least two male plug low-frequency signal terminals, and a first of the male plug shield terminals being located between the first male plug high-frequency signal terminal and the at least two male plug low-frequency signal terminals;

a second of the male plug high-frequency signal terminals being located at a right side of the at least two male plug low-frequency signal terminals; and a second of the male plug shield terminals being located between the second male plug high-frequency signal terminal and the at least two male plug low-frequency signal terminals.

3. The male plug according to claim 2, wherein:

the male plug insulation body comprises a first bottom portion, a protruding first tongue portion, a protruding second tongue portion, and a protruding third tongue portion;

the protruding first tongue portion being located at a left side of the first male plug shield terminal, the protruding second tongue portion being located between the first male plug shield terminal and the second male plug shield terminal, and the protruding third tongue portion being located at a right side of the second male plug shield terminal;

the two male plug shield terminals being embedded inside the first bottom portion and being in a long strip shape, and top surfaces of the two male plug shield terminals being flushed with a surface of the first bottom portion;

one end of each of the two male plug shield terminals being adjacent to an inner wall surface of the male plug shield housing, and another end of each of the two male plug shield terminals being adjacent to the inner wall surface of the male plug shield housing; the first contact portion of the first male plug high-frequency signal terminal being fixed on the protruding first tongue portion, and the first fixing portion of the first male plug high-frequency signal terminal being embedded inside the first bottom portion; and the first contact portion of the second male plug high-frequency signal terminal being fixed on the protruding third tongue portion, the first fixing portion of the second male plug high-frequency signal terminal being embedded inside the first bottom portion, the second contact portion of each of the male plug low-frequency signal terminals being fixed on the protruding second tongue portion, the second fixing portion of each of the male plug low-frequency signal terminals being embedded inside the first bottom portion.

4. The male plug according to claim 3, wherein the first male plug high-frequency signal terminal and the second male plug high-frequency signal terminal are rotationally symmetric, and the at least two male plug low-frequency signal terminals are arranged in pairs in which each pair of the male plug low-frequency signal terminals is rotationally symmetric to another.

5. The male plug according to claim 3, wherein the male plug high-frequency signal terminal, the male plug low-frequency signal terminals and the male plug shield terminals are fixed together by inserting molding.

6. A female socket, comprising:

a female socket insulation body;

at least two female socket high-frequency signal terminals arranged on the female socket insulation body;

at least two female socket low-frequency signal terminals arranged on the female socket insulation body;

a female socket shield terminal located between the female socket low-frequency signal terminals and the female socket high-frequency signal terminals; and a female socket shield housing arranged on the female socket insulation body;

wherein the female socket shield terminal being embedded inside the female socket insulation body.

7. The female socket according to claim 6, wherein:

each of the female socket high-frequency signal terminals comprises a third contact portion being in an U-shape and a third fixing portion being in a L-shape, and each of the female socket low-frequency signal terminals comprises a fourth contact portion being in an U-shape and a fourth fixing portion being in a long strip shape;

the female socket shield terminal being in a strip shape and being high in middle and low in both sides;

one end of the female socket shield terminal being adjacent to an inner wall surface of the female socket housing and another end of the female socket shield terminal being adjacent to the inner wall surface of the female socket housing;

the number of the female socket high-frequency signal terminals being two and the number of the female socket shield terminals being two;

a first of the female socket high-frequency signal terminals being located at a left side of the at least two female socket low-frequency signal terminals, and a first of the female socket shield terminals being located between first female socket high-frequency signal terminals and the at least two female socket low-frequency signal terminals;

a second of the female socket high-frequency signal terminals being located at a right side of the at least two female socket low-frequency signal terminals; and a second of the female socket shield terminals being located between the second female socket high-frequency signal terminal and the at least two female socket low-frequency signal terminals.

8. The female socket according to claim 7, wherein:

the female socket insulation body comprises a second bottom, a first slot, a second slot, and a third slot;

the first slot being located at a left side of the first female socket shield terminal, the second slot being located between the first female socket shield terminal and the second female socket shield terminal, and the third slot being located at a right side of the second male plug shield terminal; and the third contact portion of the first female socket high-frequency signal terminal being fixedly connected to the first slot, the third contact portion of the second female socket high-frequency signal terminal being fixedly connected to the third slot, and the fourth contact portion of each of the female socket low-frequency signal terminals being fixedly connected to the second slot.

9. The female socket according to claim 8, wherein the first female socket high-frequency signal terminal and the second female socket high-frequency signal terminal are rotationally symmetric, and the at least two female socket low-frequency signal terminals are arranged in pairs in which each pair of the female socket low-frequency signal terminals is rotationally symmetric to another.

10. The female socket according to claim 8, wherein the female socket low-frequency signal terminals and the second slot are fixed together by inserting molding.

11. A board-to-board radio frequency (RF) connector, comprising:

a male plug, comprising:

a male plug insulation body;

at least two male plug high-frequency signal terminals arranged on the male plug insulation body;

at least two male plug low-frequency signal terminals arranged on the male plug insulation body;

a male plug shield terminal located between the male plug low-frequency signal terminals and the male plug high-frequency signal terminals; and a male plug shield housing arranged on the male plug insulation body;

wherein the male plug shield terminal is embedded inside the male plug insulation body; and a female socket, comprising:

a female socket insulation body;

at least two female socket high-frequency signal terminals arranged on the female socket insulation body;

at least two female socket low-frequency signal terminals arranged on the female socket insulation body;

a female socket shield terminal located between the female socket low-frequency signal terminals and the female socket high-frequency signal terminals; and a female socket shield housing arranged on the female socket insulation body;

wherein the female socket shield terminal being embedded inside the female socket insulation body; and wherein the male plug and the female socket are mated, a first contact portion of each of the male plug high-frequency signal terminals are contacted with a third contact portion of each of the female socket high-frequency signal terminals and a second contact portion of each of the male plug low-frequency signal terminals are contacted with a fourth contact portion of each of the female socket low-frequency signal terminals.

12. The board-to-board radio frequency (RF) connector according to claim 11, wherein;

each of the male plug high-frequency signal terminals comprises a first contact portion being in an arched shape and a first fixing portion being in a long strip shape, and each of the male plug low-frequency signal terminals comprises a second contact portion being in an arched shape and a second fixing portion being in a long strip shape;

the number of the male plug high-frequency signal terminals being two and the number of the male plug shield terminal being two;

a first of the male plug high-frequency signal terminals being located at a left side of the at least two male plug low-frequency signal terminals, and a first of the male plug shield terminals being located between the first male plug high-frequency signal terminal and the at least two male plug low-frequency signal terminals; and a second of the male plug high-frequency signal terminals being located at a right side of the at least two male plug low-frequency signal terminals, and a second of the male plug shield terminals being located between second male plug high-frequency signal terminals and the at least two male plug low-frequency signal terminals.

13. The board-to-board radio frequency (RF) connector according to claim 12, wherein:

the male plug insulation body comprises a first bottom portion, a protruding first tongue portion, a protruding second tongue portion, and a protruding third tongue portion;

the protruding first tongue portion being located at a left side of the first male plug shield terminal, the protruding second tongue portion being located between the first male plug shield terminal and the second male plug shield terminal, and the protruding third tongue portion being located at a right side of the second male plug shield terminal;

the two male plug shield terminals being embedded inside the first bottom portion and being in a long strip shape, and top surfaces of the two male plug shield terminals being flushed with a surface of the first bottom portion;

one end of each of the two male plug shield terminals being adjacent to an inner wall surface of the male plug shield housing, and another end of each of the two male plug shield terminals being adjacent to the inner wall surface of the male plug shield housing;

the first contact portion of the first male plug high-frequency signal terminal being fixed on the protruding first tongue portion, and the first fixing portion of the first male plug high-frequency signal terminal being embedded inside the first bottom portion; and the first contact portion of the second male plug high-frequency signal terminal being fixed on the protruding third tongue portion, the first fixing portion of the second male plug high-frequency signal terminal being embedded inside the first bottom portion, the second contact portion of each of the male plug low-frequency signal terminals being fixed on the protruding second tongue portion, the second fixing portion of each of the male plug low-frequency signal terminals being embedded inside the first bottom portion.

14. The board-to-board radio frequency (RF) connector according to claim 13, wherein the first male plug high-frequency signal terminal and the second male plug high-frequency signal terminal are rotationally symmetric, and the at least two male plug low-frequency signal terminals are arranged in pairs in which each pair of the male plug low-frequency signal terminals is rotationally symmetric to another.

15. The board-to-board radio frequency (RF) connector according to claim 13, wherein the male plug high-frequency signal terminal, the male plug low-frequency signal terminals and the male plug shield terminals are fixed together by inserting molding.

16. The board-to-board radio frequency (RF) connector according to claim 11, wherein:

each of the female socket high-frequency signal terminals comprises a third contact portion being in an U-shape and a third fixing portion being in a L-shape, and each of the female socket low-frequency signal terminals comprises a fourth contact portion being in an U-shape and a fourth fixing portion being in a long strip shape;

the female socket shield terminal being in a strip shape and being high in middle and low on both sides;

one end of the female socket shield terminal being adjacent to an inner wall surface of the female socket housing and another end of the female socket shield terminal being adjacent to the inner wall surface of the female socket housing;

the number of the female socket high-frequency signal terminals being two and the number of the female socket shield terminals being two;

a first of the female socket high-frequency signal terminals being located at a left side of the at least two female socket low-frequency signal terminals, and a first of the female socket shield terminals being located between the first female socket high-frequency signal terminal and the at least two female socket low-frequency signal terminals; and a second of the female socket high-frequency signal terminal being located at a right side of the at least two female socket low-frequency signal terminals, and a second of the female socket shield terminals being located between the second female socket high-frequency signal terminal and the at least two female socket low-frequency signal terminals.

17. The board-to-board radio frequency (RF) connector according to claim 16, wherein:

the female socket insulation body comprises a second bottom, a first slot, a second slot, and a third slot;

the first slot being located at a left side of the first female socket shield terminal, the second slot being located between the first female socket shield terminal and the second female socket shield terminal, and the third slot being located at a right side of the second male plug shield terminal; and the third contact portion of the first female socket high-frequency signal terminal being fixedly connected to the first slot, the third contact portion of the second female socket high-frequency signal terminal being fixedly connected to the third slot, and the fourth contact portion of each of the female socket low-frequency signal terminals being fixedly connected to the second slot.

18. The board-to-board radio frequency (RF) connector according to claim 17, wherein the first female socket high-frequency signal terminal and the second female socket high-frequency signal terminal are rotationally symmetric, and the at least two female socket low-frequency signal terminals are arranged in pairs in which each pair of the female socket low-frequency signal terminals is rotationally symmetric to another.

19. The board-to-board radio frequency (RF) connector according to claim 17, wherein the female socket low-frequency signal terminals and the second slot are fixed together by inserting molding.

* * * * *